US006032719A

United States Patent [19]

Baum

[11] Patent Number: 6,032,719

[45] **Date of Patent: *Mar. 7, 2000**

[54] METHOD FOR PRODUCING HOLLOW JEWELRY RING

[76] Inventor: Robert Baum, 857 Fifth Ave., New York, N.Y. 10021

[ * ] Notice: This patent is subject to a terminal disclaimer.

[21] Appl. No.: 09/140,585

[22] Filed: Aug. 26, 1998

Related U.S. Application Data

[62] Division of application No. 08/985,794, Dec. 5, 1997, which is a continuation of application No. 08/878,207, Jun. 18, 1997, Pat. No. 5,718,278, which is a continuation of application No. 08/571,759, Dec. 13, 1995, abandoned.

[51] Int. Cl.[7] ..... B22C 9/04; B22C 7/02

[52] U.S. Cl. ..... 164/35; 164/45

[58] Field of Search ..... 164/35, 45, 235, 164/249

[56] References Cited

U.S. PATENT DOCUMENTS

| | | | |
|---|---|---|---|
| 404,956 | 6/1889 | Burdon . | |
| 703,170 | 6/1902 | Baldt . | |
| 840,946 | 1/1907 | Levy . | |
| 1,050,370 | 1/1913 | McGlashan et al. . | |
| 1,285,882 | 11/1918 | Zielinski . | |
| 1,365,672 | 1/1921 | Fawcett . | |
| 1,365,702 | 1/1921 | Knadler . | |
| 1,398,706 | 11/1921 | Rust . | |
| 2,078,562 | 4/1937 | Cohen et al. | 22/114 |
| 2,103,413 | 12/1937 | Gaertner | 29/160.6 |
| 3,401,738 | 9/1968 | Parille | 164/353 |
| 3,511,466 | 5/1970 | Kaplan | 249/57 |
| 3,554,875 | 1/1971 | MacKinney et al. | 204/9 |
| 3,561,521 | 2/1971 | Reneer | 164/45 |
| 3,562,900 | 2/1971 | Buehler | 29/527.6 |
| 3,838,728 | 10/1974 | Voegele | 164/45 |
| 3,991,809 | 11/1976 | Voegele | 164/35 |
| 4,392,289 | 7/1983 | Michaud | 29/160.6 |
| 4,530,740 | 7/1985 | Wolf et al. | 204/9 |
| 4,630,346 | 12/1986 | Singer | 29/160.6 |
| 4,681,664 | 7/1987 | Eberle et al. | 204/9 |
| 4,710,276 | 12/1987 | Kull | 204/9 |
| 4,722,770 | 2/1988 | Blottiere et al. | 204/9 |
| 4,761,206 | 8/1988 | Forrest | 204/9 |
| 4,811,778 | 3/1989 | Allen et al. | 164/516 |
| 5,172,568 | 12/1992 | Senanayake | 63/2 |
| 5,393,405 | 2/1995 | Iacono et al. | 205/72 |
| 5,606,873 | 3/1997 | Zeller et al. | 63/15 |
| 5,690,477 | 11/1997 | Haimoff | 164/35 |
| 5,718,278 | 2/1998 | Baum | 164/35 |

FOREIGN PATENT DOCUMENTS 2-232002 9/1990 Japan .

*Primary Examiner*—Harold Pyon
*Assistant Examiner*—I. H. Lin
*Attorney, Agent, or Firm*—Whitman Breed Abbott & Morgan LLP; Nathaniel Levin

[57] ABSTRACT

A process for fabricating a hollow or partially hollow article, such as a jewelry ring, comprises producing a first mold having an inner cavity shaped in accordance with the external shape of the article to be produced. A second mold is produced for forming a wax core insert which is inserted in the first mold cavity for forming the hollow region of the article. The second mold has an inner cavity formed in the shape of, but slightly smaller than, the external shape of the article. The cavity of the second mold has holes which form spacer pins on the wax core insert. The wax core insert is then placed in the cavity of the first mold and is maintained in a precise, predetermined position by the spacer pins. During waxing of the article, a plastiwax is introduced into and fills the cavity of the first mold, completely surrounding the wax core insert. The plastiwax hardens and is removed from the first mold cavity with the wax core insert. The wax core insert is then removed from the plastiwax article by suitable water soluble or chemical means to form a hollow plastiwax article which is a replica of the desired metal article. The plastiwax replica is then used to form a mold cavity in an investment material, which is used to cast the hollow metal article.

48 Claims, 2 Drawing Sheets

METHOD FOR PRODUCING HOLLOW JEWELRY RING

CROSS-REFERENCE TO RELATED APPLICATIONS

This is a divisional application of copending prior application Ser. No. 08/985,794, filed Dec. 5, 1997; which is a continuation of application Ser. No. 08/878,207, filed Jun. 18, 1997 (now U.S. Pat. No. 5,718,278); which was a continuation of application Ser. No. 08/571,759, filed Dec. 13, 1995, now abandoned.

FIELD OF THE INVENTION

The present invention relates to a method for producing a hollow article and to a hollow article produced in accordance therewith. More particularly, the present invention relates to a method for casting or molding an article of jewelry, such as a ring, having a solid construction in a region exposed to external stress and a hollow construction in a region exposed to minimal external stress.

BACKGROUND INFORMATION

There are a variety of well known processes used in large volume production. These known processes include die striking, casting and electroforming, all of which are used for producing metallic articles, and injection molding, which is generally used for producing plastic articles. These known production methods are capable of facilitating high volume, high speed production with excellent reproducibility. Using permanent-mold casting or injection molding techniques, for example, a single mold cavity may be used repeatedly to produce at a low cost a virtually unlimited number of indistinguishable articles of intricate detail and of any size.

While processes such as die striking and injection molding of parts for casting are generally recognized as being highly efficient manufacturing processes for precious metal manufacturing, there has been a recent trend toward the development of manufacturing processes having an even greater level of productivity and a decreased production cost.

In this regard, most improved manufacturing processes are directed at improvements in production equipment. There is, however, a practical limitation on the level of cost reduction made possible by means of improved machinery or industrial efficiency techniques. While productivity may be enhanced to maximize throughput by improving equipment design, at a certain level production costs can no longer be decreased. This is due to the fact that the largest cost component of a high volume manufacturing process of precious metal jewelry is the cost of the materials used in the production of a finished jewelry article.

While previous improvements in production processes have focused mainly upon improvements in the equipment used for the production of a particular article, or on the method of operating such equipment, there has been a general lack of advancement or improvement of production processes which are directed to modifying the manufactured article itself rather than modifying the equipment used for producing the article. For instance, by developing a process which minimizes the amount of raw materials (e.g., precious metals) used for production of an article, the production cost of the article can be substantially decreased. Despite this, few methods are known for reducing the amount of raw materials, and among the methods that are known there are serious limits to the application thereof to ring designs.

For example, several methods have been developed to reduce the amount of raw materials used for producing an article, each resulting in an article having a hollow construction in regions unexposed to appreciable external stress. By reducing the amount of material used in the finished article, the largest component of the production cost used for fabricating the article may be reduced, far in excess of that possible by simply enhancing production throughput.

One such method is electroforming, which is commonly used in the production of hollow metallic articles, notably various articles of jewelry, such as earrings, pendants, pins and bracelets—but not rings. Using electroforming techniques, a thin layer of a precious metal is deposited onto a chemically soluble substrate to form a desired article. After deposition of the metallic layer, the substrate is removed by a suitable chemical treatment, leaving only the thin metallic layer.

The electroforming process suffers from severe limitations in both the design and the type of articles which may be produced thereby. For example, electroforming techniques are suitable only for articles which are completely hollow in construction, and cannot be used to produce articles which are exposed to an appreciable external stress. While electroforming is capable of producing articles having intricate detail, articles produced by such a technique possess a very low tensile strength due to their hollow construction. This is the reason why rings are not produced using this technique.

The use of acid or water soluble wax inserts in mold cavities to mold partially or completely hollow articles is another method used for the reduction of production costs by reducing the amount of precious metal in the end product. According to this technique of molding with wax, commonly referred to as "waxing", a soluble wax core insert is placed in a mold cavity. Then a molten plastiwax (a plastic/wax substance) is injected into the mold cavity, filling the cavity and surrounding the core insert. The core insert is then removed to produce a plastiwax article having a hollow core.

The use of soluble wax core inserts is equally problematic. Difficulties in achieving the proper alignment of the insert and in preventing random movement or shifting of the insert during waxing or casting have plagued the use of inserts in waxing or casting processes for articles such as rings. As a result, the use of inserts has achieved only limited success and is generally limited to processes in which precision is of little concern or in which the volume of the insert is relatively small compared to the overall volume of the article in the region surrounding the insert.

SUMMARY OF THE INVENTION

In view of the foregoing, it is an object of the present invention to provide an improved process for producing articles, such as jewelry rings, constructed of a reduced quantity of raw material, especially a reduced quantity of precious metals.

It is another object of the present invention to provide a process for producing an article, such as a jewelry ring, having a solid construction in a region exposed to an external working stress and a hollow construction in a region minimally exposed to an external working stress.

In order to achieve these objects and others, in accordance with one aspect of the present invention a process is provided for fabricating a hollow or partially hollow article. In accordance with the process, a first mold is produced having an inner cavity shaped in accordance with the external shape of the article to be produced. A second mold is produced for forming a wax core insert which is inserted in the first mold cavity for forming the hollow region of the article. The second mold has an inner cavity formed in the shape of, but slightly smaller than, the external shape of the article. The cavity of the second mold has holes which form spacer pins on the wax core insert. The spacer pins maintain the wax core insert in precise alignment within the cavity of the first mold during waxing of the article and determine with high precision the wall thickness of the hollow portion of the article.

The wax core insert is formed in the second mold by introducing a soluble wax into the second mold cavity. The soluble wax core insert is then placed in the cavity of the first mold and is maintained in a precise, predetermined position by the spacer pins. During the waxing of the article, a plastiwax is introduced into and fills the cavity of the first mold, completely surrounding the soluble wax core insert. The plastiwax hardens and is removed from the first mold cavity with the soluble wax core. The core is then removed from the formed plastiwax article by suitable water soluble or chemical means. Thus, an article may be produced with intricate detail and with a solid portion and a hollow portion unlike the conventional art.

In accordance with another aspect of the present invention, a process is provided for producing a ring having a hollow construction in the crown portion thereof and with an inner round radius design.

BRIEF DESCRIPTION OF THE DRAWINGS

The following description of preferred embodiments of the invention will be better understood when read in conjunction with the appended drawings. It should be understood, however, that the invention is not limited to the precise arrangements shown, in which.

DETAILED DESCRIPTION OF THE PREFERRED EMBODIMENTS

The inventive method for producing hollow or semi-hollow articles is of broad applicability to many technical fields for the production of an infinite variety of articles. For illustrative purposes only, a preferred mode for carrying out the inventive method will be described hereinafter in connection with the production of a jeweled article, namely, a ring.

Figure 5A:
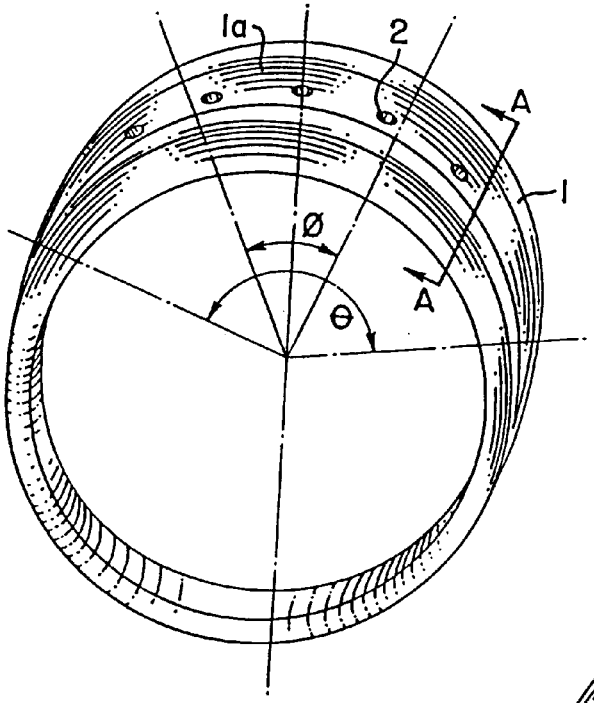
FIG. 5(A) is a perspective view showing the desired shape of a ring produced in accordance with the method of the present invention.

In this regard, it is presumed that the ornamental design of the jeweled article is carried out in the conventional manner, which is typically initiated with a sketch or other rendering of the desired article. For a ring or setting having a crown portion capable of mounting thereon gem stones or facsimiles thereof, it will be assumed for the purposes of the present description that the ornamental design of the ring 1 has stone-mounting openings 2 as shown in FIG. 5(A). Of course, the ornamental design and the relative dimensions of the article are intended to be in no way limited to, or by, any aspect of the design shown in FIG. 5(A), and it should be recognized that this design is used herein for illustrative purposes only.

Moreover, it should be kept in mind that the present invention is not limited to the production of any particular type or style of article, such as a ring. To the contrary, it will be readily apparent to those of ordinary skill in the art that the inventive method has broad applicability over a wide spectrum in terms of the design, style and type of article which may be produced in accordance herewith. As will become apparent to those of ordinary skill in the art, the method of the present invention may be practiced to produce articles made of materials capable of being formed by a variety of industrial processes including, but not limited to die casting (under high or low pressure), injection molding, forging, sand casting, permanent-mold casting, centrifugal casting, lost wax investment casting, shell casting, or the like. For illustrative purposes only, the description hereinafter provided will be directed to a practical embodiment employing the loss wax casting process (commonly known as "casting") to produce the ring as shown in FIG. 5(A).

Briefly, casting is the production of an article having a desired shape by introduction of a molten material (usually a metal) into a previously prepared mold cavity where the molten material is caused to solidify and to take on the shape of the cavity, which is shaped in the form of the article to be produced. Because of the distinct advantages of casting, it has, since its inception, remained an important and integral production process. With ordinary casting processes it is possible to produce articles having intricate shapes and details of an almost unlimited size range, with very narrow portions and thin wall sections when necessary, from any material that can be melted, with metal being placed where needed for the best resistance to working stresses and having virtually no directional properties.

The waxing processes generally utilize a two-part mold which defines an outer cavity having the desired shape. Each part of the mold defines one half of the cavity. Due to imperfect mating characteristics and shrinkage of the hardened material, a seam is produced in the molded or cast article at the portion of the article adjoining the interface between the two mold parts.

The above-described mold seam is inevitable in molds using two or more parts for defining an inner cavity, and the seam cannot be avoided. In order to reduce or minimize the mold seam, however, conventional molding and casting processes use die configured to form the seam in an unnoticeable area of the article or to form the seam over as small and area of the article as possible.

In the case of a ring, for example, the two mold die are generally configured such that each has a cavity shaped like one half of the ring to be produced thereby, taken in a radial direction. In accordance with this configuration, a mold seam is provided at only two portions on the surface of the molded ring and may be easily removed by filing and polishing. In order to minimize the seam in this manner, the conventional mold is vertically oriented and each of the two die used in the conventional mold defines a cavity shaped like one-half of the ring, as shown by the dashed line in FIG. 5(A).

Figure 5B:
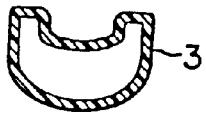
FIG. 5(B) is a cross-sectional view of the ring shown in FIG. 5(A) taken along line A—A'.
Figure 6:
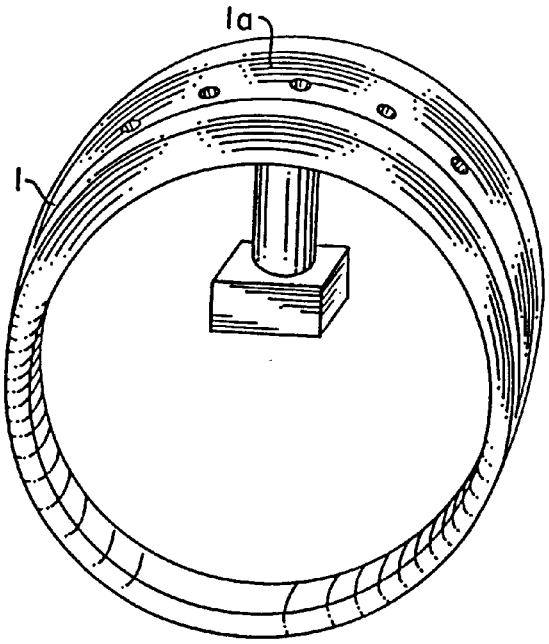
FIG. 6 is a perspective view of the ring shown in FIG. 5(A) having a locator peg affixed to the inner surface of the ring.

Using the conventional techniques and the vertically oriented mold configuration, it is impossible to produce a ring having an inner round radius design, such as that shown in FIG. 5(B), wherein the curvature of a cross-section of the ring is such that it is narrower proximate the finger than at its outer surface.

Figure 1:
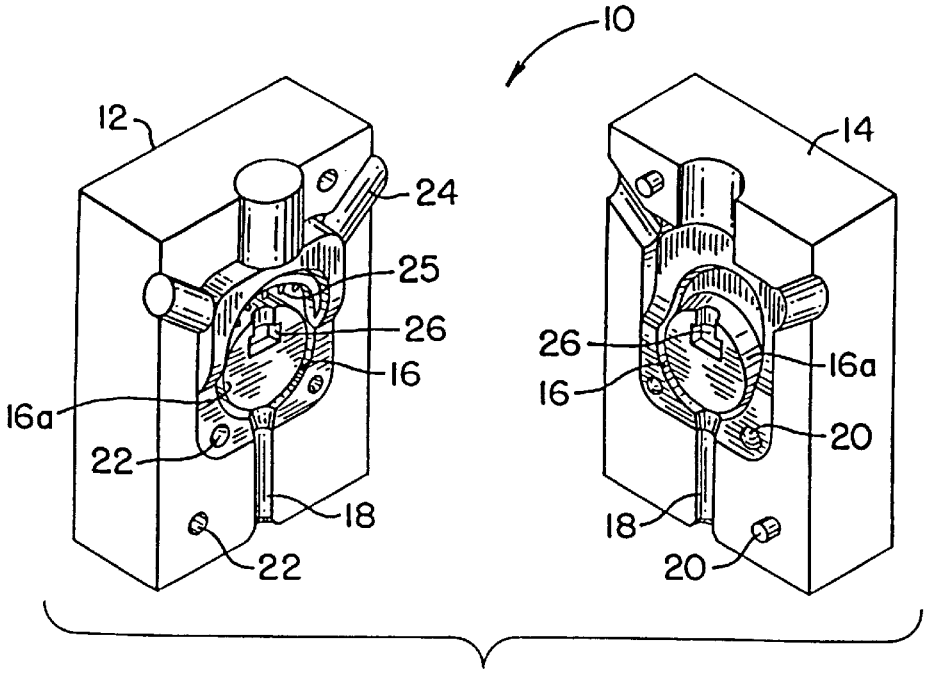
FIG. 1 is a perspective view of the upper and lower die of a ring mold used for waxing a ring having a hollow crown portion in accordance with the method of the present invention.

Thus, to produce a ring having an inner round radius design, a horizontally oriented mold configuration is necessary. FIG. 1 shows a ring mold 10 used to produce the ring 1 shown in FIG. 5(A). The mold 10 comprises a lower die 12 and an upper die 14 which define an inner cavity 16 having the shape of the ring 1 of FIG. 5(A).

As will be appreciated by those of ordinary skill in the art, the mold 10 of FIG. 1, while shown in vertical orientation for ease of discussion only, is a horizontal mold.

Unlike the vertically oriented mold conventionally used for producing a ring, the ring mold 10 is oriented with the lower die 12 and the upper die 14 arranged to define a cavity 16 having the shape of the ring 1. Each die 12,14 is formed with a cavity defining substantially one-half the ring shape in an axial direction.

As shown, the mold cavity 16 has the same shape as the external shape of the ring 1 shown in FIG. 5(A). To facilitate the proper alignment of the lower and upper die 12,14, locator pins 20 are provided to fit in corresponding locator holes 22 provided in the respective die. Preferably, several locator pins 20 and corresponding locator holes 22 are provided on the die 12,14 to prevent relative movement between the upper and lower die during production. The mold 10 is also provided with an inlet port 18 for injection of the molten plastiwax used for the later casting of the ring.

Figure 2:
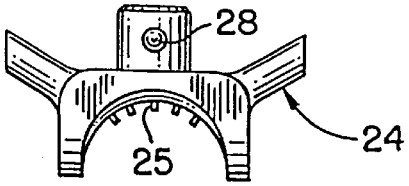
FIG. 2 is a front view of a removable insert used in the mold of FIG. 1.
Figure 4:
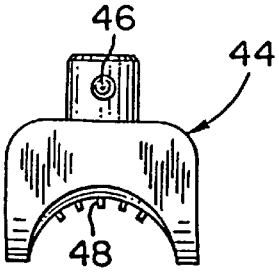
FIG. 4 is a front view of a removable insert used in the mold of FIG. 3.

As shown more clearly in FIG. 2, the mold 10 is provided with a removable metal crown insert 24. The crown insert 24 is provided with locator pins 25 along its inner arch. These locator pins serve a dual purpose. First, the locator pins 25 form the stone-mounting openings 2 in the finished ring product 1, as shown in FIG. 5(A), for the mounting of gem stones or other decorations in the crown portion of the ring 1. As described in further detail below, the locator pins 25 are also used to align and locate a soluble wax core insert 50 placed in the cavity 16 during the waxing process to form the wax replica of the desired ring and during subsequent casting of the ring itself.

A locator pin 28 is provided on the metal crown insert 24 to properly mate the crown insert 24 with the lower die 12 via a corresponding locator hole (not shown) provided in the die 12. For larger inserts, a plurality of locator pins and corresponding locator holes may be used to ensure an integral connection.

The mold cavity 16 may be produced by known methods, which include the use of CAD/CAM, pantograph or other techniques. Of course, conventional cutting tools and soft-metal mold making may be used to form the die and the details of the cavity.

The mold cavity 16 must be of the desired shape and size, with due allowance for shrinkage of the solidifying material. Any complexity of shape desired in the finished casting must also exist in the cavity. It is also important that the material from which the mold is made must be such as to reproduce the desired detail and must be of such a refractory character that it will not be too greatly affected by the molten material which is to be introduced into the mold cavity.

A suitable means of melting the plastiwax or other material introduced into the mold cavity must be available. The melting equipment must provide an adequate temperature and also produce a product of satisfactory quality. Such equipment is well known and commercially available.

In addition, a satisfactory method must be provided for introducing the molten plastiwax into the mold and permitting and assuring the escape of all air or gases trapped in the mold cavity prior to and during its being filled with the molten plastiwax, or which my result from the action of the plastiwax on the mold. These considerations must be met in order to permit the plastiwax to completely fill all the details of the cavity and result in a satisfactory casting which is dense and free from defects such as air holes or voids. Adequate provision must be made for the shrinkage which results when the plastiwax cools and solidifies.

It must be possible to remove the solidified plastiwax article without damage thereto. In processes where molds of a permanent nature are used for waxing, this is a major problem. The removable crown insert 24 used with the mold 10 of FIG. 1 permits the waxed ring to be easily removed.

In view of the foregoing considerations, it should be kept in mind that the material used for the mold 10 must be compatible with the material used to produce the wax replica. The melting point of the mold 10 must be above that of the molten material used to produce the waxed article. Otherwise, the mold cavity 16 will deform, resulting in an unacceptable cast article. The mold 10 shown in FIG. 1 may therefore be formed of aluminum or a similar metal having a relatively high melting point, and the mold cavity may be formed of a metallic alloy containing a softer material, such as lead, which is easily shaped into a mold using ordinary die making tools and which can withstand the temperature and pressure changes that occur during the waxing process. To form the mold cavity 16, the mold 10 may be heated to an appropriate temperature, and a model of the ring having the desired shaped pressed into the cavity portion 16 of the mold 10.

Figure 7:
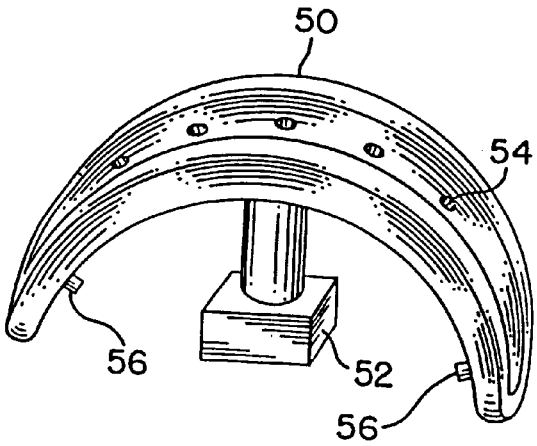
FIG. 7 is a perspective view of a soluble wax core insert produced in the mold cavity shown in FIG. 3 and used to form a hollow crown portion of a ring in accordance with the method of the present invention.

As shown in FIG. 1, a receptacle 26 is formed in each of the upper die 14 and lower die 12. As will be described below, the receptacle 26 is used to hold a soluble wax core insert 50 in place during injection of the molten plastiwax so that the wax replica is cast with a hollow core portion. The receptacle 26 is formed during formation of the mold cavity 16, with the receptacle 26 being formed in the cavity itself, and a model of the desired ring has a peg affixed to the inner round surface thereof, as shown in FIG. 7. Using the model, the cavity 16 is formed with the desired shape and with the receptacle 26.

Figure 3:
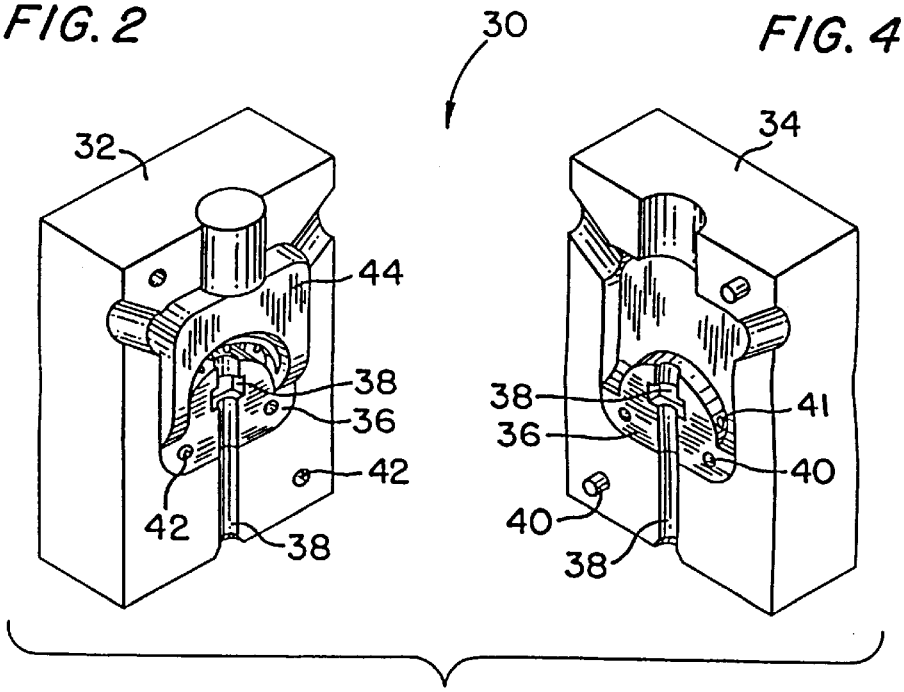
FIG. 3 is a perspective view of the upper and lower die of a mold used to form a wax core insert in accordance with the method of the present invention.

As described above, the ring 1 has a hollow crown portion 1*a* which is produced using a soluble wax core insert 50 (shown in FIG. 7) which is placed in the mold cavity 16 prior to waxing of the ring 1 and which is removed from the wax replica by water soluble or chemical means. To produce the core insert 50, a second mold must be formed. As shown in FIG. 3, such a mold 30 comprises a pair of die 32,34 formed in horizontal arrangement, similar to FIG. 1, and having a cavity shape similar to and slightly smaller than (i.e., offset) the crown portion 1*a* of the ring 1.

As shown in FIG. 3, the second mold 30 used to form the core insert 50, shown in FIG. 7, for use in waxing the ring 1 with a hollow crown region 1*a* is of similar construction to the first mold 10 used to cast the ring 1 and includes a lower die 32, an upper die 34, a cavity 36, a receptacle 38, locator pins 40, holes 41, 42, and a removable metal crown insert 44 with locator pins 46 and 48.

As shown, the cavity 36 of the second mold 30 is shaped like the crown portion of the ring 1. The removable crown insert 44 is configured to provide the mold cavity 36 with a slightly smaller size than the outer dimensions of the crown portion 1*a* of the ring 1, so as to produce the wax core insert 50 which is slightly smaller than the outer dimensions of the crown portion 1*a* of the ring 1. The wax core insert 50 has the same shape as the crown portion 1*a* of the ring 1 except that it is somewhat smaller (offset) to permit the crown portion of the ring to be waxed by fully surrounding the wax core insert 50 with molten plastiwax in the first mold 10. Applicant has found that an offset of $^{15}/_{1000}$ to $^{40}/_{1000}$ of an inch, and preferably $^{25}/_{1000}$ to $^{30}/_{1000}$ of an inch, permits the ring to be produced with a hollow crown portion of suitable strength to withstand external forces to which jewelry rings are ordinarily subjected during use, including the relatively large stress forces encountered in sizing the rings. On the other hand, applicant has found that a smaller offset results in a hollow crown portion having too thin a wall thickness such that even a small amount of stress may deform the wall of the hollow crown. For example, at offsets less than $^{15}/_{1000}$ of an inch, the wall thickness is thin enough to be deformed by squeezing it with a person's fingers. Most preferably, the wax crown insert should be formed to be at least $^{17}/_{1000}$ of an inch smaller than the outer dimensions of the crown portion 1*a* of the ring 1 to ensure an adequate wall thickness in the crown. At or above this offset, the crown portion is relatively strong and capable of withstanding ordinary levels of external stress.

As shown in FIG. 7, the wax core crown insert 50 is formed with an alignment peg 52 having the identical shape as that of the receptacle 26 formed in the cavity 26 of the first mold 10. Holes 54 are formed in the wax core insert 50 by the locator pins 48 on the removable crown insert 44 used in the second mold 30. The alignment peg 52 and locator holes 54 serve to maintain the wax core insert 50 stationary in the mold cavity 16 of the first mold 10. In addition, spacer pins 56 are formed on the legs of the wax core insert 50 by the cavity holes 41 in the upper die 34. The spacer pins 56 are provided at carefully selected locations to prevent rotation of the core insert 50 as well as relative movement of either leg of the insert during casting of the ring 1 in the first mold 10, as described hereinafter.

The wax core insert 50 shown in FIG. 7 is produced using a water soluble wax substance. First, molten core wax is introduced into an inlet port 38 of the second mold 30, and hardened. The wax core is then removed from the mold 30 and cleaned. Rough edges and seams are then removed, and the wax core insert 50 is ready for use in waxing the ring 1.

To fabricate the ring 1 shown in FIG. 5(A) with a hollow crown portion, the wax core insert 50 is placed in the first mold cavity 16 such that the alignment peg 52 is fitted in the receptacle 26. The ends of the spacer pins 56 formed on the inner surface or inside radius of the wax core insert 50 engage with the inner wall portion 16*a* of the mold cavity 16 and serve to prevent the legs of the core insert 50 from undergoing lateral movement during the casting of the ring. The pins 25 on the removable metal crown insert 24 are placed in the holes 54 in the core insert 50 and cooperate with the spacer pins 56 to retain the core insert 50 in place. Thus, a precise clearance between the inner surface of the mold cavity 16 and the wax core insert 50 is established and precisely maintained whereby the ring 1 may be cast with a hollow crown portion 1*a* having a thin, uniform wall thickness.

After the wax core insert 50 is precisely positioned within the mold cavity 16, a molten plastiwax is introduced into and fills the mold cavity 16, completely surrounding the wax core insert 50. After hardening, the plastiwax article is removed from the mold cavity with the wax core insert 50 intact. The wax core insert 50 is then removed by water soluble or chemical means in a manner well known in the art, thereby producing a plastiwax ring replica 1 having a hollow crown portion 1*a*.

In accordance with the present invention, two, three or more spacer pins 56 are used to prevent displacement of the wax core insert 50 during waxing of the ring. The spacer pins 56 maintain with a high degree of precision a predetermined clearance between the inner wall 16*a* of the mold cavity 16 and the core insert 50, which enables casting of a hollow crown portion of thinner wall thickness and of greater arcuate extent than has heretofore been possible. For example, use of the spacer pins 56 enables casting of wall thicknesses as thin as $^{15}/_{1000}$ of an inch, whereas prior art techniques produce a minimum wall thickness of about $^{35}/_{1000}$ of an inch. In addition, as shown in FIG. 5(A), the arcuate range $\theta$ of hollowness attainable with the present invention, due to provision of the spacer pins 56, is on the order of 160°–180°, whereas prior art techniques typically attain a practical arcuate range $\phi$ of hollowness no greater than approximately 60°–70°.

The plastiwax ring replica 1 is used to produce a cast metal ring, for example, by the loss wax casting method. Typically, a desired quantity of plastiwax ring replicas are produced using the method described above. The plastiwax ring replicas are mounted on a wax pole of approximately ⅜ inch diameter (the rings-on-a-pole assembly is known in the trade as a "tree"). A cylinder is placed around the tree, and then an investment material is poured into the cylinder completely covering the tree.

The investment material is preferably a plaster-of-Paris type of material, which is strengthened either by the addition of small fibers or by reducing the amount of water used in the standard investment formula. The strengthened investment is necessary to hold the investment cores in place (e.g., to prevent lift-off movement of the cores during the in-rush of molten metal) and to prevent breakage during the subsequent casting process.

The cylinder is then placed under a bell jar which is placed under vacuum to remove any air from the investment material. The level of vacuum is sufficient to ensure the flow of investment material into the hollow interiors of the plastiwax ring replicas (i.e., into the hollow interior portions created by removal of the wax core inserts 50). Then the cylinder is placed on a steam table for dewaxing, following which the cylinder is placed in an oven, usually for 10–14 hours, for completion of the dewaxing and baking of the investment.

After all of the plastiwax is removed and the investment is sufficiently baked, the cylinder is placed in a casting machine. At this point, the baked investment defines a mold cavity which corresponds precisely to the original wax tree, i.e., the investment mold cavity is the negative of the wax tree which is the positive. The most commonly used casting techniques are centrifugal, vacuum and vacuum-assisted. During the casting process, molten metal such as gold, platinum or other jewelry metals and alloys, is injected into the investment mold cavity. After the metal is cast, the investment material is removed using pressurized water or other physical means to thereby produce a metal tree which is an exact replica or duplication of the original wax tree.

The individual cast metal rings are removed from the metal pole by clipping and then the rings are polished and finished (e.g., mounting of stones).

While the present invention has been described with reference to specific embodiments, it is understood that the invention is not so limited but rather includes any and all changes and modifications thereto which would be apparent to those skilled in the art and which come within the spirit and scope of the appended claims.

I claim:

1. A method of producing a hollow metal jewelry ring, the method comprising the steps of:

providing a mold having a first mold cavity shaped in accordance with an external shape of the ring to be produced;

providing a core insert formed of a soluble material, said core insert having a shape in accordance with, but slightly smaller than, a portion of the ring to be produced;

positioning the core insert in the first mold cavity;

introducing a molten material into the first mold cavity to surround the core insert and fill the first mold cavity, and hardening the molten material to form a replica of the ring to be produced;

removing the replica from the first mold cavity;

removing the core insert from the replica to leave a hollow space within the replica;

after said removing steps, forming a second mold cavity in an investment material using the replica; and casting the hollow metal jewelry ring in the second mold cavity;

wherein the first mold cavity and the core insert each have an arcuate portion, the arcuate portion of the core insert having an arcuate extent of at least 140°.

2. A method according to claim 1, wherein the arcuate extent of the arcuate portion of the core insert is substantially 160°.

3. A method according to claim 1, wherein the core insert is formed of water soluble wax.

4. A method according to claim 1, wherein said mold is formed of metal.

5. A method of producing a hollow metal jewelry ring, the method comprising the steps of:

providing a mold having a first mold cavity shaped in accordance with an external shape of the ring to be produced, said mold including a pair of die formed in a horizontal arrangement;

providing a core insert formed of a soluble material, said core insert having a shape in accordance with, but slightly smaller than, a portion of the ring to be produced;

positioning the core insert in the first mold cavity;

introducing a molten material into the first mold cavity to surround the core insert and fill the first mold cavity, and hardening the molten material to form a replica of the ring to be produced;

removing the replica from the first mold cavity;

removing the core insert from the replica to leave a hollow space within the replica;

after said removing steps, forming a second mold cavity in an investment material using the replica; and casting the hollow metal jewelry ring in the second mold cavity.

6. A method according to claim 5, wherein the core insert is formed of water soluble wax.

7. A method according to claim 5, wherein said die are formed of metal.

8. A method of producing a hollow metal jewelry item having an inner round radius design, the method comprising the steps of:

providing a mold having a first mold cavity shaped in accordance with an external shape of the item to be produced;

providing a core insert formed of soluble material, said core insert having a shape in accordance with, but slightly smaller than a portion of the item to be produced;

positioning the core insert in the first mold cavity;

introducing a molten material into the first mold cavity to surround the core insert and fill the first mold cavity, and hardening the molten material to form a replica of the item to be produced, the replica having said inner round radius design;

removing the replica from the first mold cavity;

removing the core insert from the replica to leave a hollow space within the replica;

after said removing steps, forming a second mold cavity in an investment material using the replica; and casting the hollow metal jewelry item in the second mold cavity.

9. A method according to claim 8, wherein the core insert is formed of water soluble wax.

10. A method according to claim 8, wherein the first mold cavity and the core insert each have an arcuate portion, and the arcuate portion of the core insert has an arcuate extent of at least 140°.

11. A method according to claim 10, wherein the arcuate extent of the core insert is substantially 160°.

12. A method according to claim 8, wherein said mold comprises a pair of die formed in a horizontal arrangement.

13. A method according to claim 12, wherein said die are formed of metal.

14. A method of producing a component of a hollow metal jewelry ring having an inner round radius design, the method comprising the steps of:

providing a mold having a first mold cavity shaped in accordance with an external shape of the component to be produced;

providing a core insert formed of a soluble material, said core insert having a shape in accordance with, but slightly smaller than, a portion of the component to be produced;

positioning the core insert in the first mold cavity;

introducing a molten material into the first mold cavity to surround the core insert and fill the first mold cavity, and hardening the molten material to form a replica of the component to be produced, the replica having said inner round radius design;

removing the replica from the first mold cavity;

removing the core insert from the replica to leave a hollow space within the replica;

after said removing steps, forming a second mold cavity in an investment material using the replica; and casting the component of the hollow metal jewelry ring in the second mold cavity.

15. A method according to claim 14, wherein the first mold cavity and the core insert each have an arcuate portion, and the arcuate portion of the core insert has an arcuate extent of at least 140°.

16. A method according to claim 15, wherein the arcuate extent of the core insert is substantially 160°.

17. A method according to claim 14, wherein said mold comprises a pair of die formed in a horizontal arrangement.

18. A method according to claim 17, wherein said die are formed of metal.

19. A method of producing a hollow metal jewelry ring having an inner round radius design, the method comprising the steps of:

providing a mold having a first mold cavity shaped in accordance with at least a portion of an external shape of the ring to be produced;

providing a core insert formed of a soluble material, said core insert having a shape in accordance with, but slightly smaller than, a portion of the ring to be produced;

positioning the core insert in the first mold cavity;

introducing a molten material into the first mold cavity to surround the core insert and fill the first mold cavity, and hardening the molten material to form a replica of at least a portion of the ring to be produced, the replica having said inner round radius design;

removing the replica from the first mold cavity;

removing the core insert from the replica to leave a hollow space within the replica;

after said removing steps, forming a second mold cavity in an investment material using the replica; and casting at least a portion of the hollow metal jewelry ring in the second mold cavity.

20. A method according to claim 19, wherein the first mold cavity and the core insert each have an arcuate portion, and the arcuate portion of the core insert has an arcuate extent of at least 140°.

21. A method according to claim 20, wherein said core insert includes an alignment member which extends radially inwardly from a central part of said arcuate portion of said core insert.

22. A method according to claim 20, wherein the arcuate extent of the core insert is substantially 160°.

23. A method according to claim 19, wherein said mold comprises a pair of die formed in a horizontal arrangement.

24. A method according to claim 23, wherein said die are formed of metal.

25. A method of producing a hollow metal jewelry ring having an inner round radius design, the method comprising the steps of:

providing a mold having a first mold cavity shaped in accordance with an external shape of the ring to be produced;

providing a core insert formed of a soluble material, said core insert having a shape in accordance with, but slightly smaller than, a portion of the ring to be produced;

positioning the core insert in the first mold cavity;

introducing a molten material into the first mold cavity to surround the core insert and fill the first mold cavity, and hardening the molten material to form a replica of the ring to be produced, the replica having said inner round radius design;

removing the replica from the first mold cavity;

after said removing step, forming a second mold cavity in an investment material using the replica; and casting the hollow metal jewelry ring in the second mold cavity.

26. A method according to claim 25, wherein the core insert is formed of water soluble wax, and further comprising the step of removing the core insert from the replica prior to forming said second mold cavity.

27. A method according to claim 25, wherein said core insert has an arcuate portion having an arcuate extent of at least 140°.

28. A method according to claim 27, wherein the arcuate extent of the core insert is on the order of 160°.

29. A method of producing a hollow ring having an inner round radius design, the method comprising the steps of:

providing a core insert formed of a soluble material, said core insert having a shape in accordance with, but slightly smaller than, a portion of the ring to be produced;

providing a mold cavity shaped in accordance with the external shape of the ring to be produced, with the core insert positioned in the mold cavity;

introducing a molten material into the mold cavity to surround the core insert and fill the mold cavity, and hardening the molten material to form the ring to be produced, the ring having said inner round radius design;

removing the ring from the mold cavity; and removing the core insert from the ring to leave a hollow space within the ring.

30. A method according to claim 29, wherein the molten material is plastiwax.

31. A method according to claim 30, wherein the core insert is formed of water soluble wax.

32. A method according to claim 29, wherein the mold cavity is defined by two metal die.

33. A method according to claim 29, wherein the core insert has an inner round radius design.

34. A method according to claim 29, wherein the core insert has an arcuate portion which has an arcuate extent of at least 140°.

35. A method according to claim 34, wherein the arcuate extent of the core insert is on the order of 160°.

36. A method according to claim 29, wherein the core insert is removed from the ring after the ring is removed from the mold cavity.

37. A method of producing a hollow metal jewelry ring, the method comprising the steps of:

providing a mold having a first mold cavity shaped in accordance with an external shape of the ring to be produced;

providing a core insert formed of a soluble material, said core insert having a shape in accordance with, but slightly smaller than, a portion of the ring to be produced;

positioning the core insert in the first mold cavity;

introducing a molten material into the first mold cavity to surround the core insert and fill the first mold cavity, and hardening the molten material to form a replica of the ring to be produced;

removing the replica from the first mold cavity;

after said removing step, forming a second mold cavity in an investment material using the replica; and casting the hollow metal jewelry ring in the second mold cavity;

wherein the first mold cavity and the core insert each have an arcuate portion, the arcuate portion of the core insert having an arcuate extent of at least 140°.

38. A method according to claim 37, wherein the arcuate extent of the arcuate portion of the core insert is substantially 160°.

39. A method according to claim 37, wherein the core insert is formed of water soluble wax.

40. A method according to claim 37, wherein the mold is formed of metal.

41. A method according to claim 37, wherein the replica is formed of plastiwax.

42. A method of producing a hollow ring, the method comprising the steps of:

providing a core insert formed of a soluble material, said core insert having a shape in accordance with, but slightly smaller than, a portion of the ring to be produced, said core insert also including an arcuate portion which has an arcuate extent of at least 140°;

providing a mold cavity shaped in accordance with the external shape of the ring to be produced, with the core insert positioned in the mold cavity;

introducing a molten material into the mold cavity to surround the core insert and fill the mold cavity, and hardening the molten material to form the ring to be produced;

removing the ring from the mold cavity; and removing the core insert from the ring to leave a hollow space within the ring, the hollow space having an arcuate shape with an arcuate extent of at least 140°.

43. A method according to claim 42, wherein the molten material is plastiwax.

44. A method according to claim 43, wherein the core insert is formed of water soluble wax.

45. A method according to claim 42, wherein the mold cavity is defined by two metal die.

46. A method according to claim 42, wherein the core insert has an inner round radius design.

47. A method according to claim 42, wherein the arcuate extent of the core insert is on the order of 160°.

48. A method according to claim 42, wherein the core insert is removed from the ring after the ring is removed from the mold cavity.

* * * * *